US006943284B2

(12) United States Patent
Didan

(10) Patent No.: US 6,943,284 B2
(45) Date of Patent: Sep. 13, 2005

(54) STABILIZER FOR TREMOLO BRIDGE

(76) Inventor: Edward William Didan, 9 Harlow St., Vernon, CT (US) 06066

( * ) Notice: Subject to any disclaimer, the term of this patent is extended or adjusted under 35 U.S.C. 154(b) by 1 day.

(21) Appl. No.: 10/683,980

(22) Filed: Oct. 14, 2003

(65) Prior Publication Data

US 2005/0076766 A1 Apr. 14, 2005

(51) Int. Cl.[7] ..... G10D 3/00
(52) U.S. Cl. ..... 84/313; 84/312 R
(58) Field of Search ..... 84/313, 312 R

(56) References Cited

U.S. PATENT DOCUMENTS 2,741,146 A * 4/1956 Fender ..... 84/313
3,411,394 A * 11/1968 Jones ..... 84/313
4,944,208 A * 7/1990 Kusek ..... 84/313
5,747,713 A * 5/1998 Clement ..... 84/313
6,100,459 A * 8/2000 Yost ..... 84/313

* cited by examiner

*Primary Examiner*—Shih-yung Hsieh

(57) ABSTRACT

A stabilizer for a tremolo bridge prevents disablement of an instrument in the event of string failure. A cam, operated by the player, serves to support a tremolo bridge such that pre-failure tuning of the remaining strings is restored. A method is disclosed for stabilizing a tremolo bridge, comprising steps of ascertaining the normal position of the bridge with strings intact and the tremolo not actuated, providing a retractable stabilizer capable of maintaining the bridge in that position, and selectively using the stabilizer to oppose disabling movement of the tremolo bridge in the event of a string failure, or for purposes of facilitating tuning of the instrument. Novel designs of the components of the stabilizer are also disclosed.

3 Claims, 4 Drawing Sheets

STABILIZER FOR TREMOLO BRIDGE

BACKGROUND OF THE INVENTION

This invention relates to tremolo devices for stringed instruments such as guitars, and more particularly to a method and apparatus for stabilizing a pivotable tremolo bridge such that an instrument equipped with such a device may continue to be played despite the breakage of a string.

In typical tremolo devices, such as those disclosed in U.S. Pat. No. 2,741,146, issued Apr. 10, 1956, to Fender, the bridge plate of the tremolo device is situated to pivot on an axis transverse to the direction of the strings. Bridge saddles located on the bridge plate engage the strings to create the intended change in string tension when the player moves the tremolo actuator arm. A counter-spring is employed to oppose and counteract the pull of the strings on the bridge plate.

A problem attendant to the use of such known tremolo devices arises with the breakage of a string. Because the tension of the strings is balanced by the above-mentioned counter-spring, loss of the force of one or more strings allows the counter-spring to displace the bridge plate. This increases the tension on the remaining strings, causing them to go sharp. Thus, the instrument becomes unplayable.

A second problem attendant to the use of such known tremolo devices arises when tuning. Because the tension of the strings is balanced by the above-mentioned counter-spring, change in force of the string being tuned causes the displacement the bridge plate. This changes the tension on the remaining strings, causing them to go out of tune. In theory, an instrument with such a bridge can't be tuned. In practice, tuning may only be achieved by repeatedly tuning each successive string until converging on an acceptable tuning for all strings. Thus, the instrument is far more difficult to tune than one with an unmoveable or stabilized bridge.

BRIEF SUMMARY OF THE INVENTION

The present invention provides a stabilizer associated with the bridge plate of a tremolo device, operable by a musician while playing, in the event of string breakage. With the present invention, the remaining strings can quickly and dependably be returned to tune despite the breakage, and the tremolo device remains operable in one direction. Thus, the instrument remains usable, allowing the player to complete a piece of music using the intact strings.

The stabilizer is also effective when the player wishes to quickly tune their instrument, as its stabilizing action accelerates the conventional process of converging on an acceptable tuning.

In its apparatus aspect, the present invention relates to a stabilizer for a tremolo device which is comprised of a cam coupled to the bridge plate of a tremolo device, for normal movement with the bridge plate. The cam is selectively operable by the player between an inoperative (retracted) position, and an operative position in which it serves to stabilize the bridge plate.

The cam is pre-set with a limit stop whereby its actuation stabilizes the bridge plate at a position providing for normal tune of the remaining strings despite the failure of any one or more strings, or for purposes of tuning the instrument.

The stabilizer, in the preferred form of the invention, is a cam, operable by the player to selectively move it into a position in which it stabilizes the bridge plate.

DESCRIPTION OF THE SEVERAL VIEWS OF THE DRAWING

There is seen in the drawings a form of the invention which is presently preferred (and which constitutes the best mode contemplated for carrying the invention into effect), but it should be understood that the invention is not limited to the precise arrangements and instrumentalities shown.

DETAILED DESCRIPTION OF THE INVENTION

Figure 1:
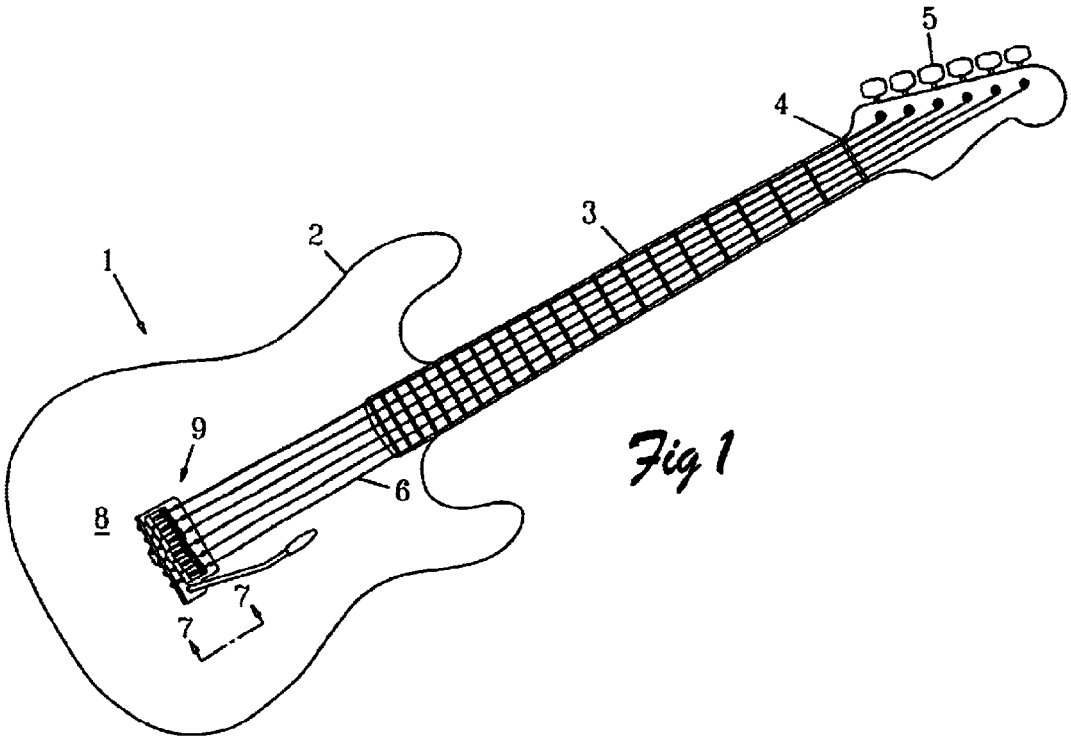
FIG. 1 is a pictorial view of a guitar utilizing the present invention.

Referring now to the drawings in detail, wherein like reference numerals indicate like elements, there is seen in FIG. 1 a guitar designated generally by the reference numeral 1. As is conventional, the guitar 1 consists of a body 2 having a sounding board or face 8. Attached to the body 2 is a neck 3, having a nut 4 and means 5 for a retaining and adjusting the pitch of the strings 6.

Figure 2:
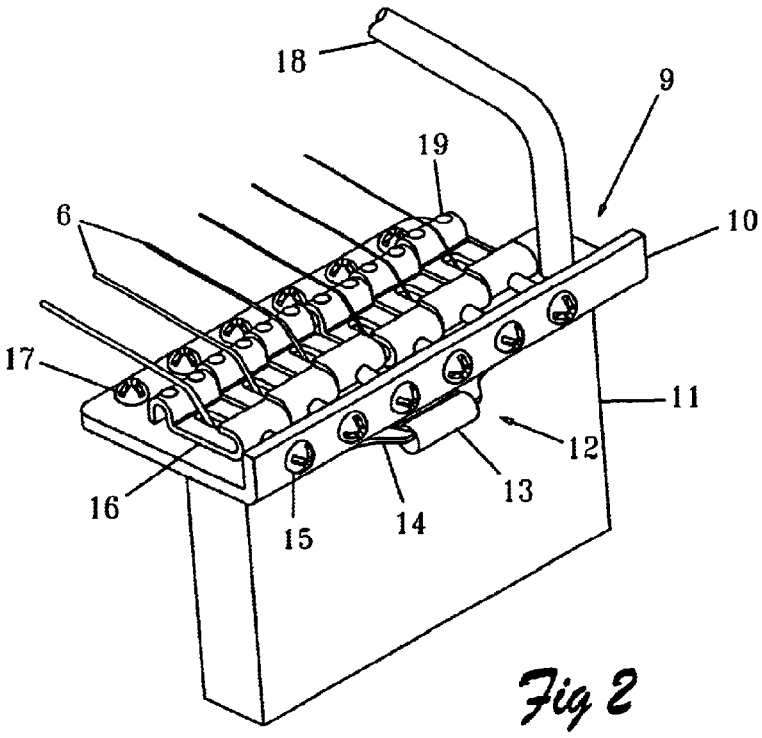
FIG. 2 is an enlarged perspective view of a tremolo device, provided with a stabilizer in accordance with the present invention.

A tremolo device, designated generally by the reference numeral 9, is secured to the face 8, and secures the bridge end of the strings 6. Referring now to FIG. 2, the tremolo device 9 includes a bridge plate 10.

Anchor screws 17 secured to the body 2 provide pivot points for the bridge plate 10. In this regard, referring to FIG. 3, the bridge plate 10 is provided with holes 24, adapted to engage the anchor screws 17. The anchor screws 17 provide a hinge for the bridge plate 10 relative to the face 8.

Figure 5:
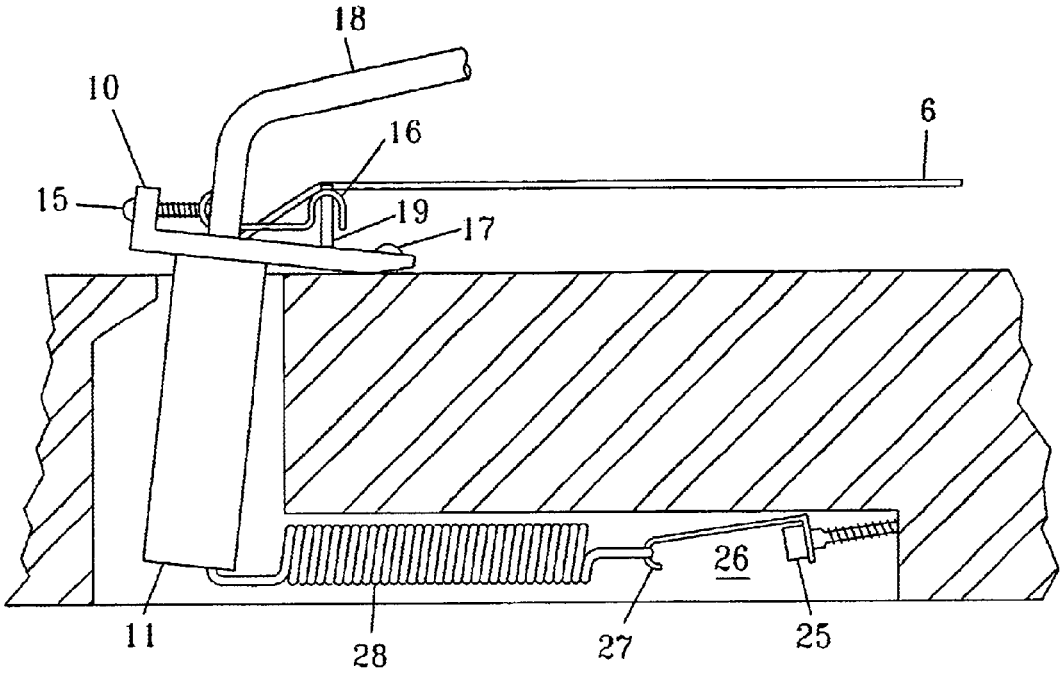
Fig 5 Prior Art
FIG. 5 is a partial cross-sectional view showing a prior art tremolo device in an operative condition.

Referring now to FIG. 5, associated with the bridge plate 10 is an inertia block 11, which projects downwardly from the bridge plate 10 and extends into a recess 26 in the body 2 of the guitar 1. The strings 6 are secured by the inertia block 11.

A tremolo actuating arm 18 is secured to the bridge plate 10. Also secured to the bridge plate 10 are bridge saddles 16, which engage the strings 6. Bridge saddles 16 have intonation screws 15 and elevation screws 19 to govern the length and height of each string respectively.

It will now be seen that movement of the actuating arm 18 causes the bridge plate 10 to pivot relative to the anchor screws 17 and face 8. The bridge 9 causes such movement to vary the tension of all of the strings 6 to produce the desired tremolo effect.

A counter-spring 28 is provided within recess 26, and coupled in tension to the body 2 and inertia block 11. Means 27 is provided to couple one end of the counter-spring 28 to an anchor screw 25, associated with the body 2.

Figure 6:
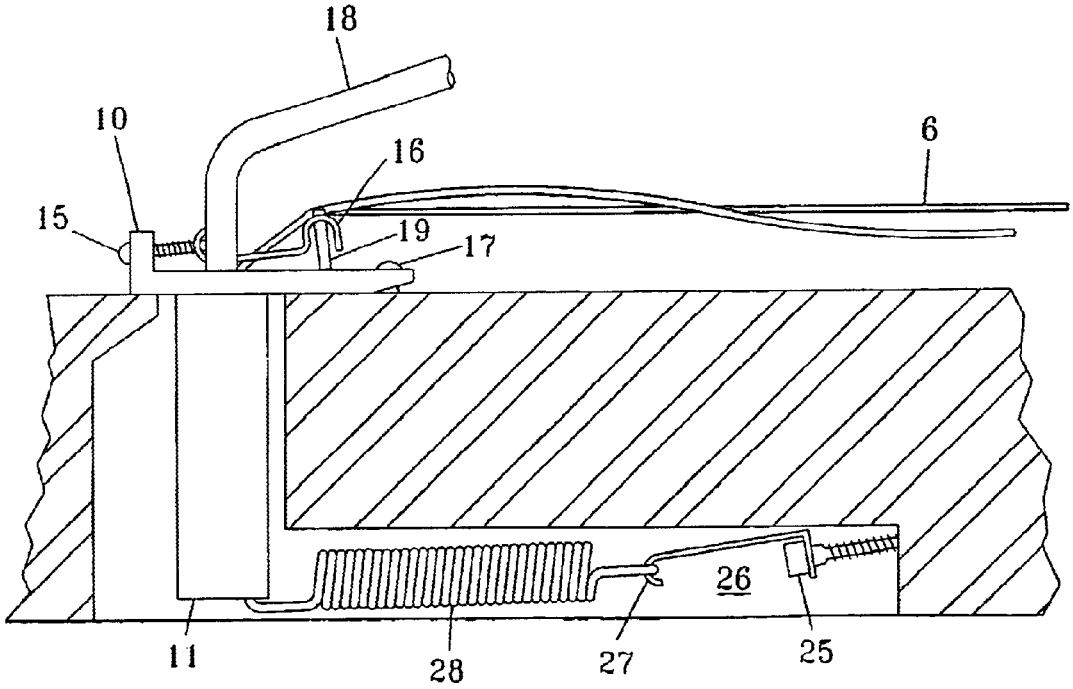
Fig 6 Prior Art
FIG. 6 is a view similar to FIG. 5, but showing the result of a string failure.

The foregoing structure is conventional, and is found in the prior art, depicted in FIGS. 5 and 6.

FIG. 6 illustrates the condition of a prior art tremolo device in the event of string failure. As can be seen, if failure of one or more of the strings 6 results in reduced force in opposition to the counter-spring 28, the counter spring 28 causes the bridge plate 10 to rotate counter-clockwise in the Figure, in general to the position shown. In such a position, the tension on the remaining strings 6, and therefore their pitch, is increased, and the instrument is no longer playable.

Figure 7:
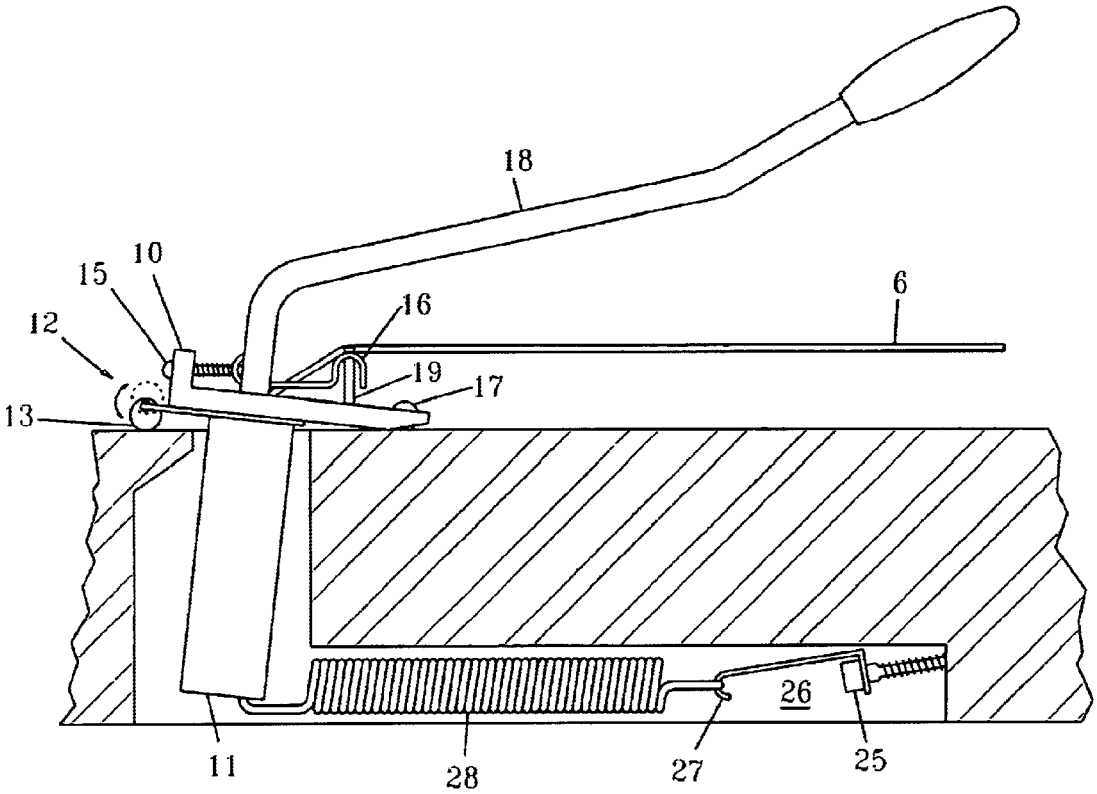
FIG. 7 is a partial sectional view taken along the line 7—7 in FIG. 1, showing the stabilizer in accordance with the invention in its operative, stabilizing, condition.

Referring now to FIGS. 2 and 7, a preferred form of the stabilizer device, in the form of a unit designated generally by the reference numeral 12, is shown in association with the bridge plate 10. The unit 12 includes a locating plate 14 and cam 13, described below in greater detail.

Figure 8:
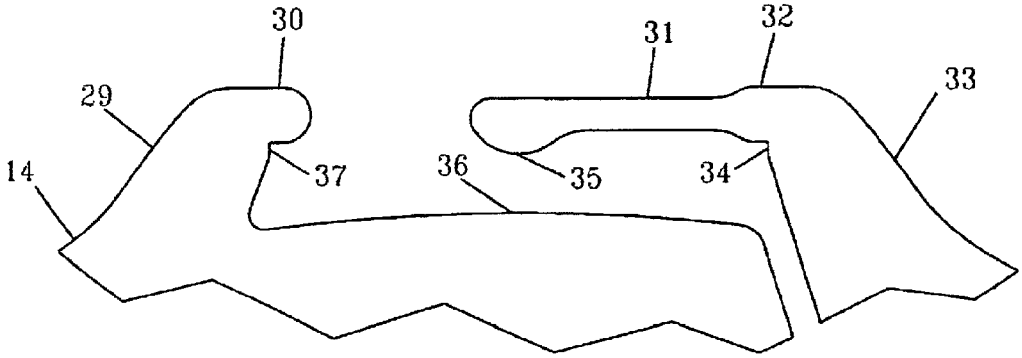
FIG. 8 is a partial view enlargement of the arms and limit stop of a locator plate in accordance with the invention.

Referring now to FIG. 8, locating plate 14 has one arm 29 with locator 30 and one arm 33 with locator 32. Extending from locator 32 is a finger 31 with pad 35. Locating plate 14 as shown has a limit stop 36.

Unit 12 may be assembled by flexing arms 29 and 33 to allow diameter 21 in cam 13 to slip over finger 31 onto locator 32 and against stop 34 on arm 33. Arms 29 and 33 are further flexed until locator 30 is slideably received into diameter 21 in cam 13, capturing it freely between stops 37 and 34. In the assembled state, finger 31 acts as a spring to maintain pad 35 in contact with the inside of diameter 21. Force exerted by finger 31 serves to maintain cam 13 in either the active or inactive positions, as the player desires.

The "engaged" or operative position is found by depressing cam 13 such that it rotates counter-clockwise as shown in FIG. 7 until it contacts stop 36.

Figure 3:
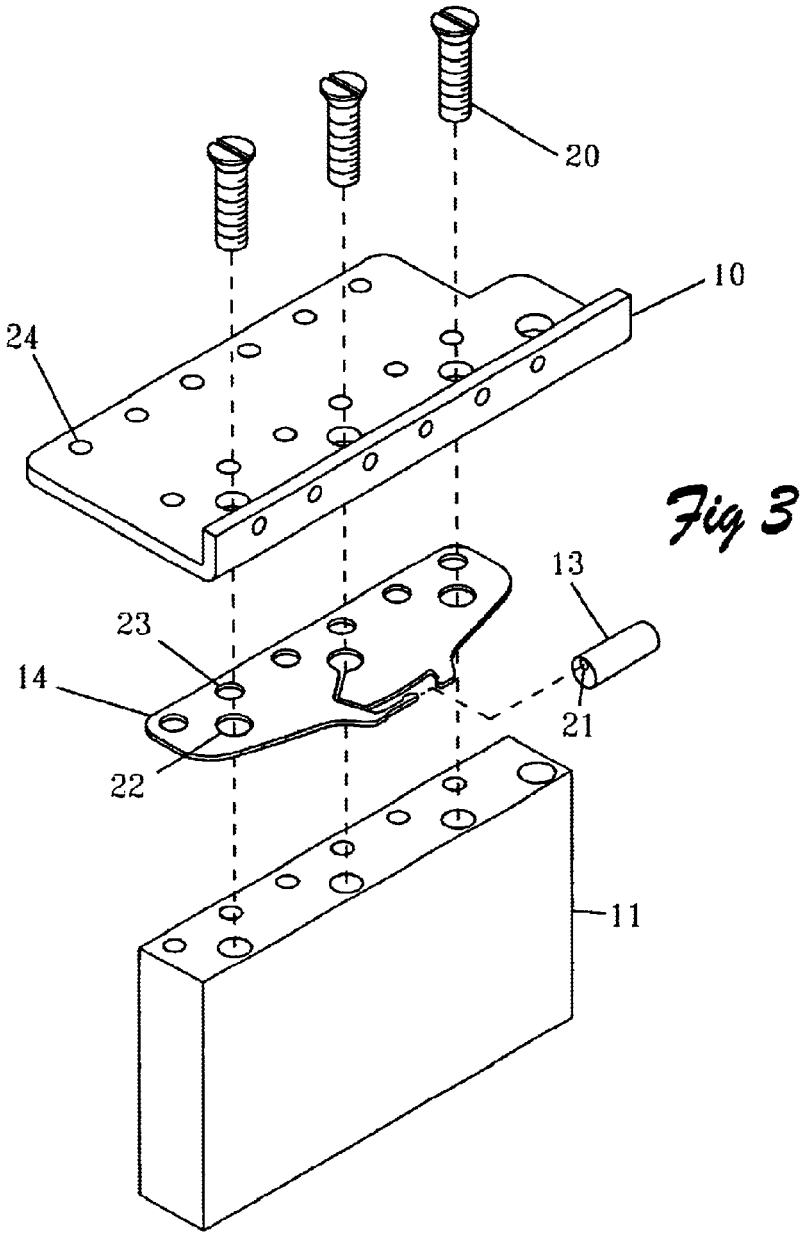
FIG. 3 is an exploded perspective view showing the assembly of the cam to locator plate, and the locator plate assembly with a prior art tremolo bridge.
Figure 4:
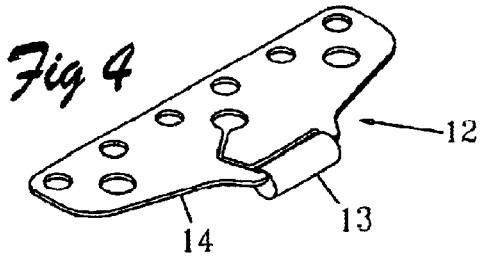
FIG. 4 is a perspective view of the stabilizer assembly.

Referring now to FIG. 3, locating plate 14 is provided with holes 22 to allow screws 20 to secure inertia block 11 to bridge plate 10. It also has holes 23 to allow strings 6 to pass from inertia block 11 through bridge plate 10.

The manner in which the stabilizer unit 12 may be mounted on a tremolo device 9 should now be apparent. The tremolo device is disassembled, and locating plate 14 of stabilizer assembly 12 is positioned between bridge plate 10 and inertia block 11 as shown in FIG. 3. Screws 20 secure the tremolo assembly.

Those skilled in the art will appreciate that other equivalent structures, such as incorporating features of the locator plate into the bridge plate, or other such mechanical arrangements, could be used to equal advantage.

Cam 13 may have a textured, knurled, notched, or other such surface to facilitate moving it between the engaged and unengaged positions.

The stabilizer unit 12 may now be deployed as follows: positioning the tremolo bridge 9 with cam 13 in the operative position, adjusting anchor screw means 25 such that the spring means 28 constrains cam 13 to face 8, tuning all strings 6 individually on the instrument by means 5, moving the cam 13 to the inoperative position, retuning all strings 6 simultaneously on the instrument by anchor screw means 25, thereby establishing the normal position of the bridge 9, and selectively moving the stabilizer 13 to the operative position, in which the stabilizer maintains the bridge 9 in said normal position, in response to failure of a string or for purposes of efficiently tuning the instrument.

It should be understood that in the event of string failure, the player can immediately operate the tremolo arm 18 to oppose the overbalancing effect of the counter-spring 28, and then with their other hand cause the cam 13 to move to the active stabilizing position, as described above.

In its method aspect, the present invention comprises steps of predetermining the position of the tremolo bridge in its normal inactive position with strings intact and in tune; providing a stabilizer unit capable of maintaining the tremolo bridge 9 in that position but allowing for actuation of the tremolo bridge in one direction in response to the tremolo arm 18; and actuating the stabilizer to limit unwanted movement of the tremolo 9 in the event of string failure, so as to permit continued playing of the instrument or for efficient tuning.

The present invention may be embodied in other specific forms without departing from its spirit or essential attributes. According, reference should be made to the appended claims rather than to the foregoing specification as indicating the scope of the invention.

I claim:

1. A stabilizer for a tremolo device of the type having a tremolo bridge plate movably coupled to the body of an instrument, strings coupled to the bridge plate, spring means coupled to the bridge plate and opposing the tension of the strings and a tremolo actuator arm coupled to the bridge plate, said stabilizer comprising: a cam operatively associated with the bridge plate, said cam having a first inoperative position and a second operative position in which it stabilizes the bridge plate by limiting movement of the bridge plate in one direction in response to the spring means, means for maintaining said cam in said first position and said second position comprising of a frictional restraint in contact with said cam, method for establishing the normal position of the bridge, said cam and said means being coupled to said bridge plate for movement therewith.

2. Apparatus in accordance with claim 1, and a limit stop coupled to said bridge plate for movement therewith, said cam having thereon means to maintain said cam in said second position when engaged with said limit stop.

3. A method for stabilizing a tremolo bridge associated with a stringed instrument, comprising the steps of positioning the tremolo bridge with a stabilizer in an operative position, adjusting a spring anchor screw means such that a spring means constrains the stabilizer to the body of the instrument, tuning all strings individually on the instrument by conventional means, moving the stabilizer to an inoperative position, retuning all strings simultaneously using the spring anchor screw means, thereby establishing the normal position of the bridge, and selectively moving the stabilizer to the operative position, in which the stabilizer maintains the bridge in said normal position, in response to failure of a string or for purposes of efficiently tuning the instrument.

* * * * *